US007988915B2

(12) United States Patent
Lee et al.

(10) Patent No.: US 7,988,915 B2
(45) Date of Patent: Aug. 2, 2011

(54) MICROFLUIDIC DEVICE USING MICROFLUIDIC CHIP AND MICROFLUIDIC DEVICE USING BIOMOLECULE MICROARRAY CHIP

(75) Inventors: Beom-seok Lee, Hwaseong-si (KR); Jeong-gun Lee, Seoul (KR); Jong-myeon Park, Seoul (KR); Yoon-kyoung Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 538 days.

(21) Appl. No.: 12/115,572

(22) Filed: May 6, 2008

(65) Prior Publication Data

US 2009/0143250 A1 Jun. 4, 2009

(30) Foreign Application Priority Data

May 23, 2007 (KR) ..... 10-2007-0050266

(51) Int. Cl.
*C40B 60/12* (2006.01)

(52) U.S. Cl. ..... 422/72; 422/533; 422/500; 422/506; 435/287.1; 435/287.2; 435/6; 435/7.1

(58) Field of Classification Search ..... 422/68.1, 422/72, 99, 100, 82.05, 82.06, 82.07, 82.08, 422/102, 537; 435/6, 287.2; 506/33, 39; 436/164, 173, 502, 503, 100, 527, 86
See application file for complete search history.

(56) References Cited

U.S. PATENT DOCUMENTS 6,706,519 B1 * 3/2004 Kellogg et al. ..... 435/287.2
2002/0106786 A1 * 8/2002 Carvalho et al. ..... 422/72
2003/0156991 A1 * 8/2003 Halas et al. ..... 422/100
2005/0074784 A1 * 4/2005 Vo-Dinh ..... 435/287.2

FOREIGN PATENT DOCUMENTS

WO WO 2006082336 A1 * 8/2006

* cited by examiner

*Primary Examiner* — Joseph Drodge
*Assistant Examiner* — Sharon Pregler
(74) *Attorney, Agent, or Firm* — Sughrue Mion, PLLC

(57) ABSTRACT

Disclosed is a microfluidic device including a microfluidic structure formed in a platform in which various examinations, such as an immune serum examination, can be automatically performed using the biomolecule microarray chip. The biomolecule microarray chip-type microfluidic device using a biomolecule microarray chip comprises: a platform which is rotatable; a microfluidic structure disposed in the platform, comprising: a plurality of chambers; a plurality of channels connecting the chambers each other; and a plurality of valves controlling flow of fluids through the channels, wherein the microfluidic structure controls flow of a fluid sample using rotation of the platform and the valves; and a biomolecule microarray chip mounted in the platform such that biomolecule capture probes bound to the biomolecule microarray chip contact the fluid sample in the microfluidic structure.

25 Claims, 10 Drawing Sheets

MICROFLUIDIC DEVICE USING MICROFLUIDIC CHIP AND MICROFLUIDIC DEVICE USING BIOMOLECULE MICROARRAY CHIP

CROSS-REFERENCE TO RELATED PATENT APPLICATIONS

This application claims priority from Korean Patent Application No. 10-2007-0050266, filed on May 23, 2007, in the Korean Intellectual Property Office, the disclosure of which is incorporated herein in its entirety by reference.

BACKGROUND OF THE INVENTION

1. Field of the Invention

Apparatuses consistent with the present invention relate to a microfluidic device, and more particularly, to a microfluidic device in which a process using a microfluidic chip can be automatically performed in a microfluidic structure formed in a platform, specifically, wherein an immune serum examination can be automatically performed using a biomolecule microarray chip.

2. Description of the Related Art

In general, a microfluidic structure of a microfluidic device includes a chamber storing a small amount of a fluid, a channel through which the fluid flows, a valve which can control flow of the fluid, and various functional units performing predetermined functions using the fluid. A lab-on-a chip is structured such that the microfluidic structure is formed in a chip-shaped substrate to perform a biochemical reaction examination including many treating and manipulating processes.

The microfluidic structure may require an operating pressure to transport a fluid. The operating pressure can be a capillary pressure or a pressure produced using a separate pump. Recently, disk-type microfluidic devices including disk-type microfluidic structures in which a fluid is transported using a centrifugal force for processes to be performed have been developed. Such a technique is called a lab compact disk (CD) or a lab-on a disk. However, the application range of the disk-type microfluidic devices is limited.

Recently, demands for microfluidic chip techniques, such as a biomolecule microarray chip technique, are increasing in medical and biotechnology fields. According to a biomolecule microarray chip technique, a plurality of biomolecule capture probes which can be specifically combined to different target materials are integrally bound to a chip-shaped substrate to detect a target material from a sample. The biomolecule capture probes may include a deoxyribonucleic acid (DNA) having a known base sequence, an antibody specifically binding to a target antigen, and the like. When the biomolecule microarray chip is used in diagnosis or experiments, manual operations such as spotting or washing of a sample, are required to be performed by skilled technicians.

A method of forming a microarray on a compact disk to detect a target material is disclosed in US Patent Publication No. US 2002/0177144 titled "Detection and/or qauntification of a target molecule by a binding with a capture molecule fixed on the surface of a disk." However, there is still a need to develop a microfluidic device efficiently using various biomolecule microarray chips, requiring less manual processes to be performed, having a short operating time, and generating fewer errors in test results using the device.

SUMMARY OF THE INVENTION

The present invention provides a microfluidic device using a microfluidic chip. In the microfluidic device, operations using various microfluidic chips formed in a platform can be automatically performed. According to the present invention, various kinds of biomolecule microarray chips can be used, and at the same time, the number of manual processes required for experiments or diagnosis using a microarray chip can be reduced significantly.

The present invention also provides an immune serum examination device in which an immune serum examination can be automatically performed using a protein microarray chip.

According to an aspect of the present invention, there is provided a microfluidic device using a biomolecule microarray chip including: a platform which is rotatable; a microfluidic structure disposed in the platform, including: a plurality of chambers; a plurality of channels connecting the chambers each other; and a plurality of valves controlling flow of a fluid through the channels, wherein the microfluidic structure controls flow of a fluid sample using rotation of the platform and the valves, and a biomolecule microarray chip mounted in the platform such that biomolecule capture probes bound to the surface of the biomolecule microarray chip contact the fluid sample in the microfluidic structure.

The microfluidic structure includes a reagent chamber storing a reagent which selectively binds a target biomolecule in the fluid sample and emits an optical indication, and a blend of the reagent and the fluid sample contacts the biomolecule microarray chip. The microfluidic structure includes a buffer solution chamber storing a buffer solution, and the microarray chip is washed with different parts of the buffer solution in a plurality of washing processes. The microfluidic structure includes a centrifugation unit separating a sample having particles into a fluid and particles using a centrifugal force generated due to rotation of the platform, wherein the fluid separated contacts the microarray chip.

The microfluidic structure includes a reaction chamber and the biomolecule microarray chip forms one of inner walls of the reaction chamber. The microfluidic structure includes: a reagent chamber storing a reagent which selectively binds a target biomolecule in the fluid sample and emits an optical indication; a buffer solution chamber storing a buffer solution; and a centrifugation unit separating a sample having particles into a fluid and particles using a centrifugal force generated due to rotation of the platform, wherein the centrifugation unit, the reaction chamber, and the buffer solution chamber are connected to the reaction chamber.

In the microfluidic device including the microarray chip forming one of inner walls of the reaction chamber, the microarray chip can be mounted in a platform using various methods. According to an embodiment of a method of mounting the microarray chip, the platform includes a top plate and a bottom plate, wherein the microfluidic structure is formed in facing surfaces of the top plate and bottom plate, an opening corresponding to the reaction chamber is formed in the bottom plate, and the opening is covered by the biomolecule microarray chip so that the reaction chamber is formed between a front surface of the biomolecule microarray chip and the top plate. According to another embodiment of a method of mounting the microarray chip, the platform includes a top plate and a bottom plate, wherein the microfluidic structure is formed in facing surfaces of the top plate and bottom plate, an opening corresponding to the reaction chamber is formed in the top plate, the biomolecule microarray chip is attached to the bottom plate exposed by the opening, and the opening is covered by a cover so that the reaction chamber is formed between a front surface of the biomolecule microarray chip and the cover. According to another embodiment of a method of mounting the microarray chip. The platform includes a top plate and a bottom plate, wherein the microfluidic structure is formed in facing surfaces of the top plate and bottom plate, the biomolecule microarray chip is attached to an inner surface of the top plate or the bottom plate, and the reaction chamber is formed between the biomolecule microarray chip and another plate to which the microarray chip is not attached.

Each biomolecule capture probe is selected from a nucleic acid, a protein, a cell, or a biochemical material, which specifically binds to a target material in a biomolecule sample.

According to another aspect of the present invention, there is provided a microfluidic device using a biomolecule microarray chip including: a platform which is rotatable; a microfluidic structure disposed in the platform, including: a plurality of chambers; a plurality of channels connecting the chambers each other; and a plurality of valves controlling flow of a fluid through the channels, wherein the microfluidic structure controls flow of a fluid sample using rotation of the platform and the valves, and a biomolecule microarray chip mounted in the platform such that biomolecule capture probes bound to the surface of the biomolecule microarray chip contact the fluid sample in the microfluidic structure, wherein the microfluidic structure includes: a centrifugation unit separating a sample having particles into a fluid and particles using a centrifugal force generated due to rotation of the platform; a reagent chamber storing a reagent which selectively binds a target biomolecule in the fluid sample and emits an optical indication; a buffer solution chamber storing a buffer solution; a reaction chamber which is connected to outlets of the centrifugation unit, reagent chamber, and buffer solution chamber and is disposed further from a rotation axis than the outlets, wherein one of inner walls of the reaction chamber is the microarray chip; and a waste chamber receiving the fluid sample from an outlet of the reaction chamber disposed further from the rotation axis than the reaction chamber.

The valves includes a valve material having heat generating particles dispersed in a phase transition material dispersion medium, and includes a phase transition valve which is melted by heat generated due to an electromagnetic wave irradiated from an external energy source and thus opens or closes the channels. Each heat dissipating particle has a core that absorbs an electromagnetic wave from the outside to be converted into a thermal energy, and a shell surrounding the core.

The microarray chip can be mounted in the platform using various methods. According to an embodiment of a method of mounting the microarray chip, the platform includes a top plate and a bottom plate, wherein the microfluidic structure is formed in facing surfaces of the top plate and bottom plate, an opening corresponding to the reaction chamber is formed in the bottom plate, and the opening is covered by the biomolecule microarray chip so that the reaction chamber is formed between a front surface of the biomolecule microarray chip and the top plate. According to another embodiment of a method of mounting the microarray chip, the platform includes a top plate and a bottom plate, wherein the microfluidic structure is formed in facing surfaces of the top plate and bottom plate, an opening corresponding to the reaction chamber is formed in the top plate, the biomolecule microarray chip is attached to the bottom plate exposed by the opening, and the opening is covered by a cover so that the reaction chamber is formed between a front surface of the biomolecule microarray chip and the cover. According to another embodiment of a method of mounting the microarray chip. The platform includes a top plate and a bottom plate, wherein the microfluidic structure is formed in facing surfaces of the top plate and bottom plate, the biomolecule microarray chip is attached to an inner surface of the top plate or the bottom plate, and the reaction chamber is formed between the biomolecule microarray chip and another plate to which the microarray chip is not attached.

According to another embodiment of the present invention, there is provided a immune serum examination device using a protein microarray chip including: a platform that is rotatable; a microfluidic structure disposed in the platform, including: a plurality of chambers; a plurality of channels connecting the chambers each other; and a plurality of valves controlling flow of a fluid through the channels, wherein the microfluidic structure controls flow of a fluid sample using rotation of the platform and the valves, and a protein microarray chip mounted in the platform such that protein capture probes bound to the surface of the protein microarray chip contact the fluid sample in the microfluidic structure.

According to another aspect of the present invention, there is provided a microfluidic device using a protein microarray chip including: a platform which is rotatable; a microfluidic structure disposed in the platform, including: a plurality of chambers; a plurality of channels connecting the chambers each other; and a plurality of valves controlling flow of a fluid through the channels, wherein the microfluidic structure controls flow of a fluid sample using rotation of the platform and the valves, and a protein microarray chip mounted in the platform such that protein capture probes bound to the surface of the protein microarray chip contact the fluid sample in the microfluidic structure, wherein the microfluidic structure includes: a centrifugation unit separating a sample having particles into a fluid and particles using a centrifugal force generated due to rotation of the platform; a reagent chamber storing a reagent which selectively binds a target protein in the fluid sample and emits an optical indication; a buffer solution chamber storing a buffer solution; a reaction chamber which is connected to outlets of the centrifugation unit, reagent chamber, and buffer solution chamber and is disposed further from a rotation axis than the outlets, wherein one of inner walls of the reaction chamber is the protein microarray chip; and a waste chamber receiving the fluid sample from an outlet of the reaction chamber disposed further from the rotation axis than the reaction chamber.

According to another aspect of the present invention, there is provided a microfluidic device including: a platform which is rotatable; a microfluidic structure disposed in the platform, including: a plurality of chambers; a plurality of channels connecting the chambers each other; and a plurality of valves controlling flow of a fluid through the channels, wherein the microfluidic structure controls flow of a fluid sample using rotation of the platform and the valves, and a microfluidic chip-receiving unit which is disposed in a portion of the microfluidic structure and includes an inlet through which a fluid is supplied to a biomolecule microfluidic chip comprised in the microfluidic chip-receiving unit and an outlet through which a fluid that has contacted the microfluidic chip is discharged. The inlet of the microfluidic chip-receiving unit is disposed closer to a rotation axis of the platform than the outlet.

In the cases in which the platform includes a top plate and a bottom plate and a microfluidic structure is formed in facing surfaces of the top and bottom plates, the microfluidic chip-receiving unit can be provided using various methods. If the microfluidic chip is a microarray chip requiring a space to contact a fluid in front of the microarry chip, the microfluidic chip-receiving unit may have the following structures.

The platform includes a top plate and a bottom plate, wherein the microfluidic structure is formed in facing surfaces of the top plate and bottom plate, an opening exposing the microfluidic chip-receiving unit is formed in the bottom plate, and the opening is covered by the microfluidic chip so as to form a chamber between a front surface of the microfluidic chip and the top plate. The platform includes a top plate and a bottom plate, wherein the microfluidic structure is formed in facing surfaces of the top plate and bottom plate, an opening exposing the microfluidic chip-receiving unit is formed in the top plate, the microfluidic chip is attached to the bottom plate exposed by the opening, and the opening is covered by a cover so as to form a chamber between a front surface of the microfluidic chip and the cover. The platform includes a top plate and a bottom plate, wherein the microfluidic structure is formed in facing surfaces of the top plate and bottom plate, the microfluidic chip-receiving unit is formed in a chamber-like form between the top plate and the bottom plate, the microfluidic chip is attached to one of inner walls of the chamber, the microfluidic chip and the other inner walls of the chamber form a space.

The microfluidic chip can be selected from a group comprising a microarray chip, a polymerase chain reaction (PCR) chip, a hexane nucleic acid refinement chip, and a sample separation chip.

BRIEF DESCRIPTION OF THE DRAWINGS

The above and other aspects of the present invention will become more apparent by describing in detail exemplary embodiments thereof with reference to the attached drawings, in which.

DETAILED DESCRIPTION OF EXEMPLARY EMBODIMENTS

Figure 1:
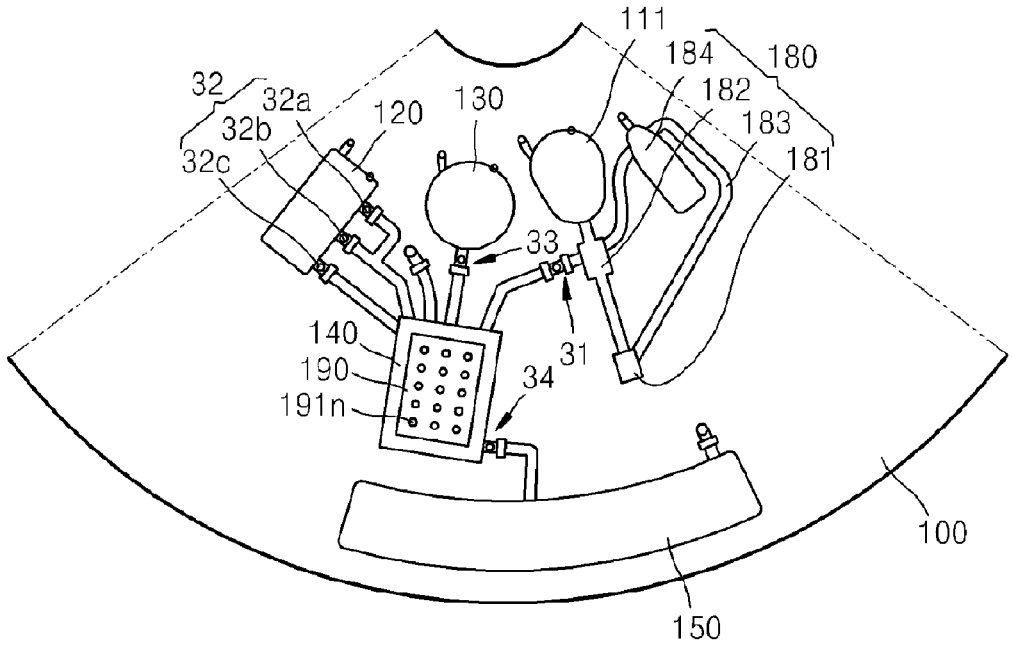
FIG. 1 is a plan view of a disk-type microfluidic device according to an exemplary embodiment of the present invention.

The present invention will now be described more fully with reference to the accompanying drawings, in which exemplary embodiments of the invention are shown. In the drawings, like designation numbers denote like elements. The structures of chambers and channels illustrated in the drawings may be simplified, and enlarged or shirked. The term "micro-" used in a micro chip or a microfluidic device is used to only have the opposite meaning to the term "macro-," and is not limited to a unit of micro.

FIG. 1 is a plan view of a disk-type microfluidic device according to an exemplary embodiment of the present invention. According to the current exemplary embodiment, a microfluidic structure including a plurality of chambers 111, 120, 130, 140, and 150, channels (shown but not denoted with designated numbers) connecting the chambers to each other, and a plurality of valves 31, 32, and 33, and 34 controlling the flow of fluids through the channels is formed in a disk-type platform 100. In some cases, multiple microfluidic structures may be formed in the disk-type platform 100. In addition, a biomolecule microarray chip 190 may be further mounted in the disk-type platform 100. The biomolecule microarray chip 190 includes a plurality of biomolecule capture probes 191*n* bound to its surface, and the biomolecule capture probes 191*n* are configured to contact a sample (not shown) which passes a portion of the microfluidic structure.

In the current exemplary embodiment, the shape of the disk-type platform 100 is not limited to a disk shape that can rotate itself For example, the disk-type platform 100 can have a fan shape that can rotate on a rotatable frame. The disk-type platform 100 can be formed of a plastic material that can be easily changed into a desired form and has a biologically inactive surface. The plastic material can be an acrylic such as polymethylmethacrylate (PMMA), polydimethylsiloxane (PDMS), polycarbonate (PC), etc. However, a material used to form the disk-type platform 100 is not limited thereto. That is, the disk-type platform 100 can be formed of other materials that are chemically and biologically stable and optically transparent, and that can be mechanically processed. The disk-type platform 100 can be a multi-layered panel. The disk-type platform 100 can have an inner space or an inner passage if the disk-type platform 100 is formed by combining panels having recessed structures corresponding to a chamber or a channel. The panels may be combined together using various methods. For example, panels can be combined together using a double-sided adhesive tape, or panels can be fused together by using ultrasonic waves.

The microfluidic structure formed in the disk-type platform 100 will now be described in detail. The microfluidic structure may include a sample chamber 111 storing a sample, such as blood, sputum, or urine, a centrifugation unit 180 which is connected to the sample chamber 111 and separates the sample into a fluid, a cell, etc, a reagent chamber 130 storing a reagent, and a buffer solution chamber 120 storing a buffer solution.

The reagent chamber 130 stores a reagent containing a material that is selectively bound to a target biomolecule in a sample and emits an optical indication, such as fluorescence, adsorption, or emission. The buffer solution chamber 120 stores a buffer solution to be used to dilute the sample or wash the surface of the microarray chip 190 contacting the sample.

The centrifugation unit 180, the reagent chamber 130, and the buffer solution chamber 120 are connected to a reaction chamber 140 through opening valves 31, 32, and 33 disposed at respective outlets in which the reaction chamber 140 is formed further from a rotation axis of the disk-type platform 100 than the respective outlets. The opening valves 31, 32, and 33 can be phase-transition type valves (refer to FIGS. 7 and 8) which are closed by valve plugs (not shown) formed of a valve material that is a solid-phase transition material containing heat generating particles dispersed therein and which are actively opened when operation energy is supplied by an external energy source. The reaction chamber 140 may include the microarray chip 190 forming a wall of the reaction chamber 140 and provides a space located before the microarray chip 190, in which various biomolecule capture probes 191*n* may contact a fluid sample. At this time, the microarray chip 190 can be mounted in the disk-type platform 100 using various methods, which will be described in detail with reference to FIGS. 4 through 6.

A waste chamber 150 is disposed further from the rotation axis of the disk-type platform 100 than the reaction chamber 140. The waste chamber 150 stores a fluid discharged from the reaction chamber 140 through an outlet of the reaction chamber 140. An opening valve (normally closing valve) 34 is disposed at the outlet of the reaction chamber 140 and allows the fluid to stay only in the reaction chamber 140 when the reaction occurs.

The centrifugation unit 180 includes a supernatant separation member 182 extending from an outlet of the sample chamber 111 in a direction opposite to the rotation axis, and includes a particle separation member 181 connected to the supernatant separation member 182 through a channel.

One side of the supernatant separation member 182 is connected to the reaction chamber 140 through the opening valve 31 and a channel. Also, the particle separation member 181 and the supernatant separation member 182 can be connected to each other through a detour channel 183. The detour channel 183 may act as a vent of the particle separation member 181. The detour channel 183 is connected to an excess sample chamber 184 at one side so that even when an excess amount of a sample is loaded to the sample chamber 111, a supernatant can be provided to the reaction chamber 140 in a constant amount.

The buffer solution chamber 120 may be connected to the reaction chamber 140 through a plurality of channels. The channels are connected to different locations of the buffer solution chamber 120 according to levels of the buffer solution stored therein. At this time, the channels may include valves 32*a*, 32*b*, and 32*c*. The valves 32*a*, 32*b*, and 32*c* can be opening valves that can independently operate. The valves 32*a*, 32*b*, and 32*c* may control the amount of a buffer solution contained in the buffer solution chamber 120 so that a predetermined amount of the buffer solution is supplied to the reaction chamber 140 so as to wash the surface of the biomolecule microarray chip 190 several times when reactions are completed.

At this time, the biomolecule microarray chip 190 can be any kind of a chip that includes various capture probes 191*n* capable of capturing a target biomolecule bound to a chip-shaped substrate in an array. For example, the chip-shaped substrate can be glass, silicon, or plastic material, and the capture probe capable of capturing a target biomolecule can be proteins, nucleic acids, cells, or other biochemical molecules.

A method of detecting a target biomolecule using the disk-type microfluidic device according to the present exemplary embodiment will now be described in detail. Specifically, an immune serum examination is performed using a protein microarray chip including protein capture probes bound to the surface of the protein microarray chip that is the biomolecule microarray chip 190 and blood that is a sample. The disk-type microfluidic device according to an exemplary embodiment of the present invention and a disk-type immune serum examination device can be more fully understood on the basis of following description. Herein, the protein microarray chip is denoted with the designation number of 190 since the protein microarray chip is an example of the biomolecule microarray chip 190.

Whole blood is loaded to a sample chamber 111 and a disk-type platform 100 is rotated. As a result, a particle separation member 181 collects heavy hemocytes, and a supernatant separation member 182 is mainly filled with a serum. When an opening valve 31 of a channel connected to a reaction chamber 140 is opened, the serum located in a portion of the supernatant separation member 182 closer to a rotation axis than a portion of the supernatant separation member 182 connected to the channel is transferred to the reaction chamber 140. Therefore, elements that can inhibit precise detection can be removed in advance.

When an opening valve 33 at an outlet of the reagent chamber 130 is opened, a reagent that has been stored therein is transferred to the reaction chamber 140. The reagent can be a material that can be used to provide optical indication, such as a detection probe material used in an enzyme-linked immunoserological assay (ELISA). When a capture probe detecting a specific target protein bound to the surface of the biomolecule microarray chip 190 is a primary antibody, the reagent may include a secondary antibody which when bound to horseradish peroxidase (HRP) results in optical indication. At this time, the reagent may include a substrate or enzyme that emits a specific color when it reacts with the HRP.

The blend of the reagent and the serum are incubated in the reaction chamber 140 for a few to tens of minutes while the blend of the reagent and the serum contacts the protein microarray chip 190. As a result, capture probes 191*n* corresponding to a target protein in a sample may capture the target protein, and a secondary antibody, that is, a material which can be used to provide optical indication, included in the reagent is bound to the target protein before or after the target protein is captured by the capture probes 191*n*.

After the reaction as described above sufficiently occurs, an opening valve 34 located at an outlet of the reaction chamber 140 is opened and then, the fluid in the reaction chamber 150 is discharged to a waste chamber 150 using a centrifugal force. Then, opening valves 32*a*, 32*b*, and 32*c* corresponding to various levels of the buffer solution chamber 120 are sequentially opened. Whenever the opening valves 32*a*, 32*b*, and 32*c* are opened, a predetermined amount of a buffer solution is transferred to the reaction chamber 140 using a centrifugal force to wash the surface of the protein microarray chip 190. The buffer solution that has been used to wash the surface of the microarray chip 190 is discharged to the waste chamber 150.

Figure 2:
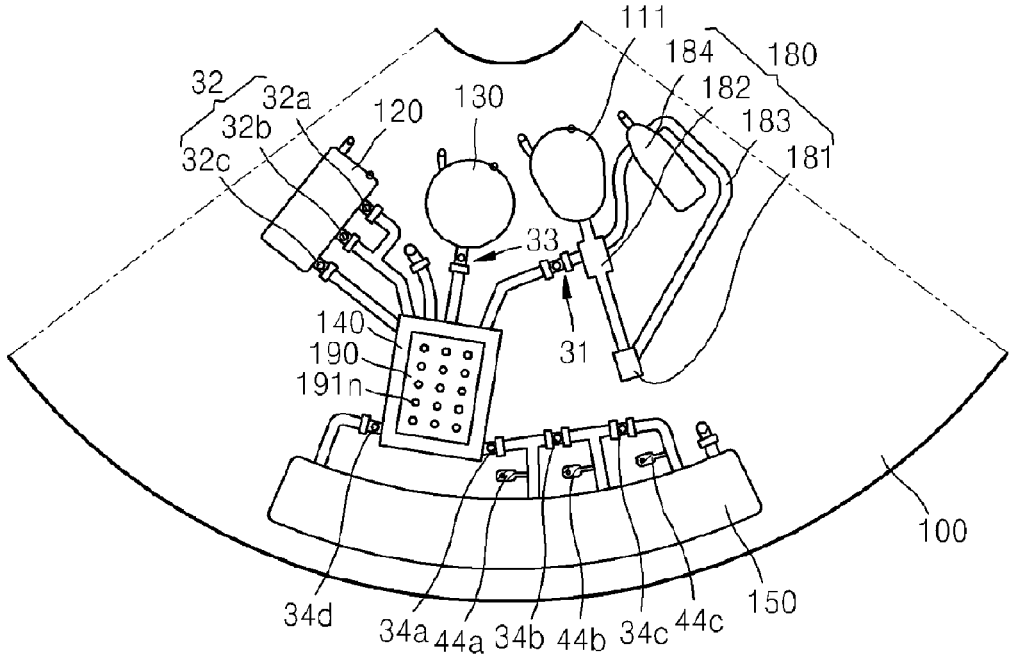
FIG. 2 is a plan view of a disk-type microfluidic device according to another exemplary embodiment of the present invention.

FIG. 2 is a plan view of a disk-type microfluidic device according to another exemplary embodiment of the present invention. The current exemplary embodiment described with reference to FIG. 2 is the same as in the previous exemplary embodiment described with reference to FIG. 1, except that the reaction chamber 140 is connected to the waste chamber 150 through four channels. Three out of the four channels include opening valves 34*a*, 34*b*, and 34*c* and closing valves 44*a*, 44*b*, and 44*c* respectively paired, and the other channel includes an opening valve 34*d*. In this structure, the reaction chamber 140 can contain and discharge the fluid four times. Specifically, initially, the reaction chamber 140 can contain and discharge the blend of the sample and the reagent once. Then, the reaction chamber 140 can contain and discharge the buffer solution three times. The number of channels may be varied as required.

Figure 3:
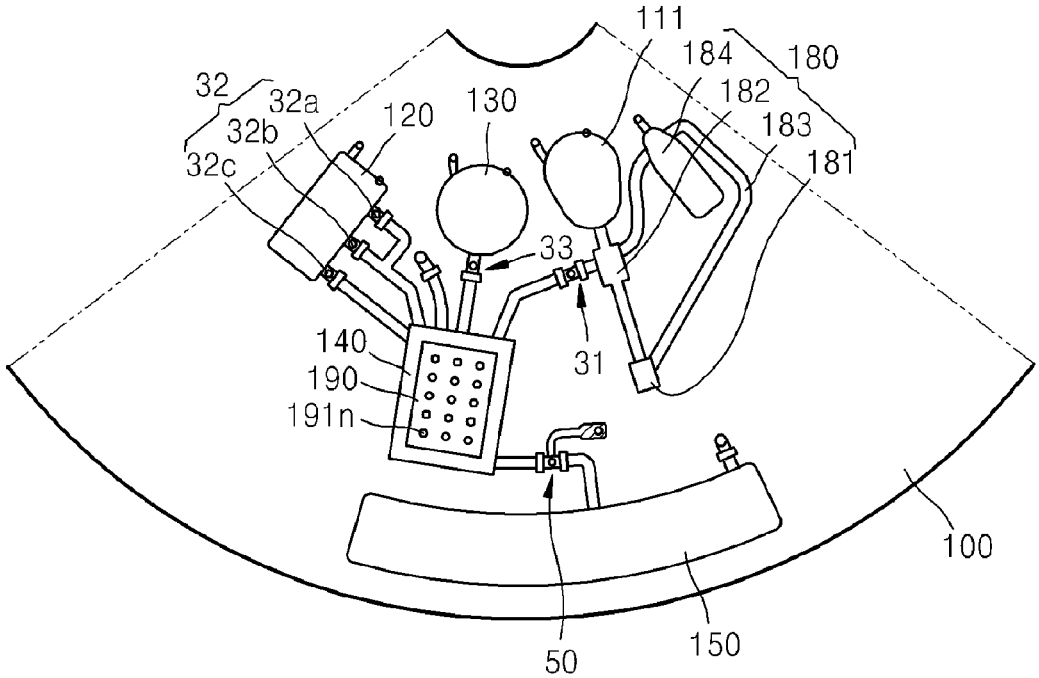
FIG. 3 is a plan view of a disk-type microfluidic device according to another exemplary embodiment of the present invention.

FIG. 3 is a plan view of a disk-type microfluidic device according to another exemplary embodiment of the present invention. The current exemplary embodiment described with reference to FIG. 3 is the same as in the previous exemplary embodiment described with reference to FIG. 1, except that an open and close type valve 50 that can be opened and closed several times is disposed in a channel connecting the reaction chamber 140 to the waste chamber 150. As described with reference to FIG. 2, the reaction chamber 140 can contain and discharge a fluid several times using the open and close type valve 50. That is, initially, the blend of the sample and the reagent is contained and discharged in the reaction chamber 140, and then, the buffer solution is contained and discharged several times. The open and close type valve 50 can be opened and closed several times. The structure and operational principal of the open and close type valve 50 will be described with reference to FIGS. 15A through 15F.

Meanwhile, the biomolecule microarray chip 190 can be mounted in the disk-type platform 100, forming a wall of the reaction chamber 140 using various methods. Three disposing methods of the biomolecule microarray chip 190 will now be described in detail. According to following exemplary embodiments (refer to FIGS. 4 through 6), a disk-type platform 100 includes a top plate 101 and a bottom plate 102, a microfluidic structure is mounted in a recessed portion between the top plate 101 and the bottom plate 102, and the top plate 101 is combined with the bottom plate 102, excluding the microfluidic structure. Although not shown in FIGS. 4 through 6, in the following exemplary embodiments, the microfluidic structure excluding the reaction chamber 140 can be formed in a concave pattern in the bottom plate 102. However, the location of the microfluidic structure is not limited thereto.

Figure 4:
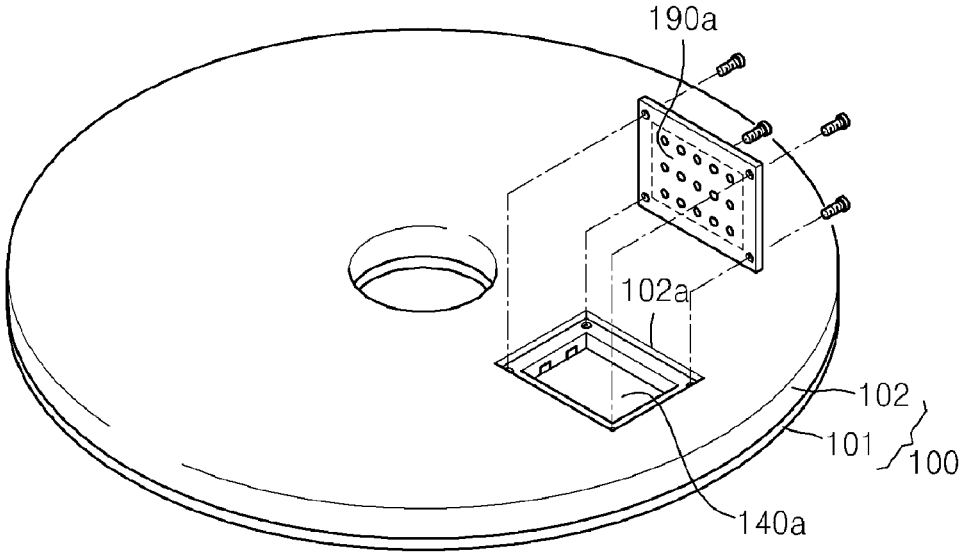
FIG. 4 is a bottom perspective view illustrating a process of mounting a biomolecule microarray chip in a disk-type microfluidic device according to an exemplary embodiment of the present invention.

FIG. 4 is a bottom perspective view illustrating a process of mounting a biomolecule microarray chip 190*a* in a disk-type microfluidic device according to an exemplary embodiment of the present invention. Specifically, FIG. 4 is a bottom view of a disk-type microfluidic device according to an exemplary embodiment of the present invention. Referring to FIG. 4, a bottom plate 102 has an opening 102*a* corresponding to a reaction chamber. A groove 140*a* which is to form the reaction chamber with the biomolecule microarray chip 190*a* is formed in the opening 102*a*. The groove 140*a* may pass through the bottom plate 102 and extend to a portion of the top plate 101. The biomolecule microarray chip 190*a* covers the opening 140*a* such that a surface of the biomolecule microarray chip 190*a* to which various biomolecule capture probes are bound faces the groove 140*a*, thereby sealing the disk-type platform 100. At this time, the biomolecule microarray chip 190*a* can be fixed to the bottom plate 102 using various methods. For example, the fixing can be achieved using screws, pieces of double-sided tape, or adhesive materials. As a result, an open surface of the groove 140*a* is covered by the biomolecule microarray chip 190*a* to form a fluid-containable space, that is, the reaction chamber.

Figure 5:
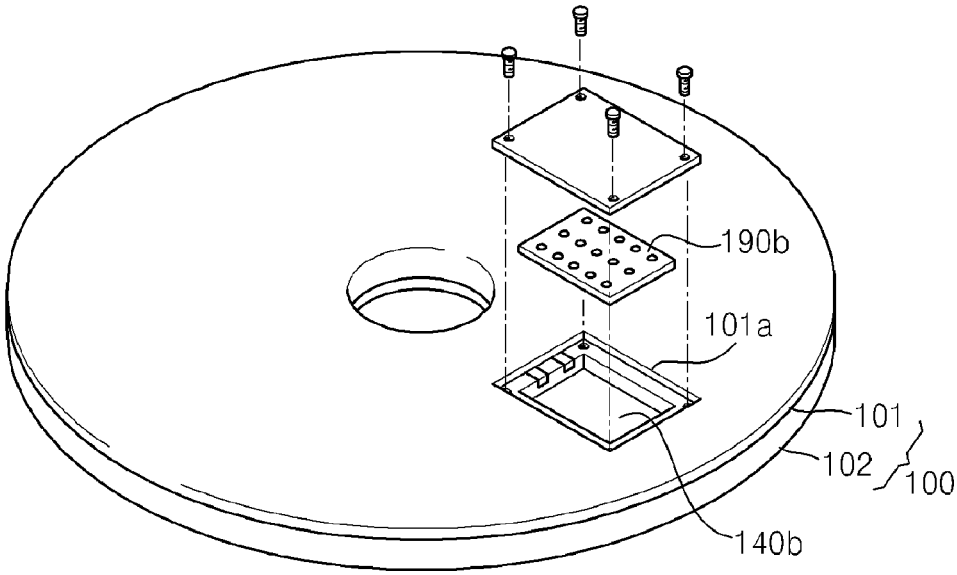
FIG. 5 is a front perspective view illustrating a process of mounting a biomolecule microarray chip in a disk-type microfluidic device according to another exemplary embodiment of the present invention.

FIG. 5 is a front perspective view illustrating a process of mounting a biomolecule microarray chip 190*b* in a disk-type microfluidic device according to another exemplary embodiment of the present invention. Specifically, FIG. 5 is a top view of a disk-type microfluidic device according to an exemplary embodiment of the present invention (refer to FIGS. 1 through 3.) Referring to FIG. 5, a top plate 101 of the disk-type platform 100 includes an opening 101*a* corresponding to a reaction chamber. A portion of a bottom plate 102 exposed by the opening 101*a* includes a groove 140*b*. The biomolecule microarray chip 190*b* is disposed at the bottom of the groove 140*b*, and the opening 101*a* is covered and sealed by a cover 101*c*. The depth of the groove 140*b* is greater than the thickness of the biomolecule microarray chip 190*b* so that a fluid-containable space can be formed between the biomolecule microarray chip 190*b* and the cover 101*c*, that is, such that the reaction chamber can be formed.

Figure 6:
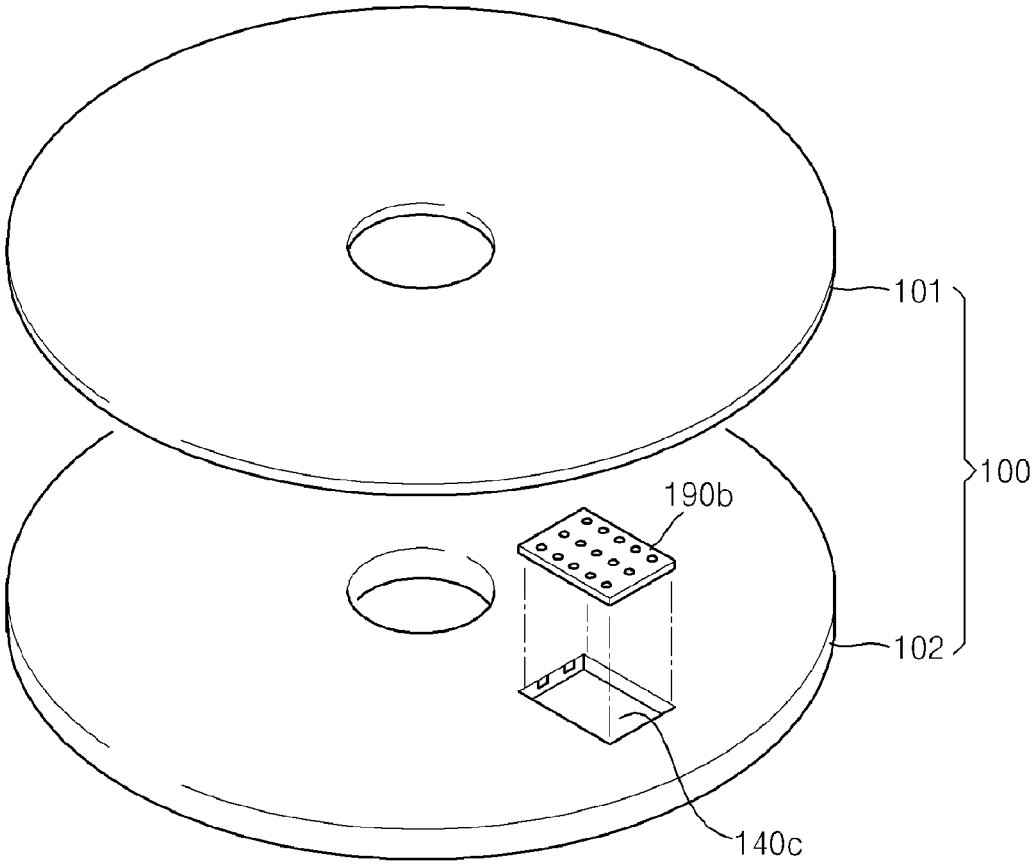
FIG. 6 is a front perspective view illustrating a process of mounting a biomolecule microarray chip in a disk-type microfluidic device according to another exemplary embodiment of the present invention.

FIG. 6 is a front perspective view illustrating a process of mounting a biomolecule microarray chip 190*b* in a disk-type microfluidic device according to another exemplary embodiment of the present invention. Specifically, FIG. 6 is a view of a disk-type platform 100*a* including a top plate 101 and a bottom plate 102 before the top plate 101 and the bottom plate 102 are combined each other. The bottom plate 102 has a groove 140*c* corresponding to a reaction chamber. The biomolecule microarray chip 190*b* is disposed at the bottom of the groove 140*c*. The depth of the groove 140*c* may be greater than the thickness of the biomolecule microarray chip 190*b* so that a fluid-containable space, that is, the reaction chamber can be formed between the top plate 101 and the biomolecule microarray chip 190*b*.

The chip mounting methods described with reference to FIGS. 4 through 6 may be suitable for mounting of a microarray chip that is a microfluidic chip. The microfluidic structures illustrated in FIGS. 1 through 3 may be suitable for an immune serum examination or a gene test using a microarray chip. However, the disk-type microfluidic device according to the exemplary embodiments of the present invention is not limited thereto. A disk-type microfluidic device according to another aspect of the present invention may include a microfluidic chip-receiving unit including various microfluidic chips, disposed in a portion of a microfluidic structure of a disk-type platform. The microfluidic chip-receiving unit may include an inlet through which a fluid is supplied to a microfluidic chip contained therein and an outlet through which the fluid that has contacted the microfluidic chip is discharged. Other kinds of microfluidic chips, in addition to the microarray chip, can also be mounted in a portion of a microfluidic structure of a disk-type platform using the methods described with reference to FIGS. 4 through 6.

Herein, the microfluidic chip can be selected from the group consisting of a microarray chip, a polymerase chain reaction (PCR) chip, a hexane nucleic acid refinement chip, and a sample separation chip. The microarray chip can be a protein microarray chip used for the immune serum examination as described above, a nucleic acid microarray chip, or a cell microarray chip. The PCR chip amplifies a gene through thermal cycling. The nucleic acid refinement chip refines a nucleic acid using a filter structure included in the chip. The sample separation chip separates a specific material from a sample containing various materials on the basis of a material transmission principle of diffusion or electrophoresis.

Figure 7:
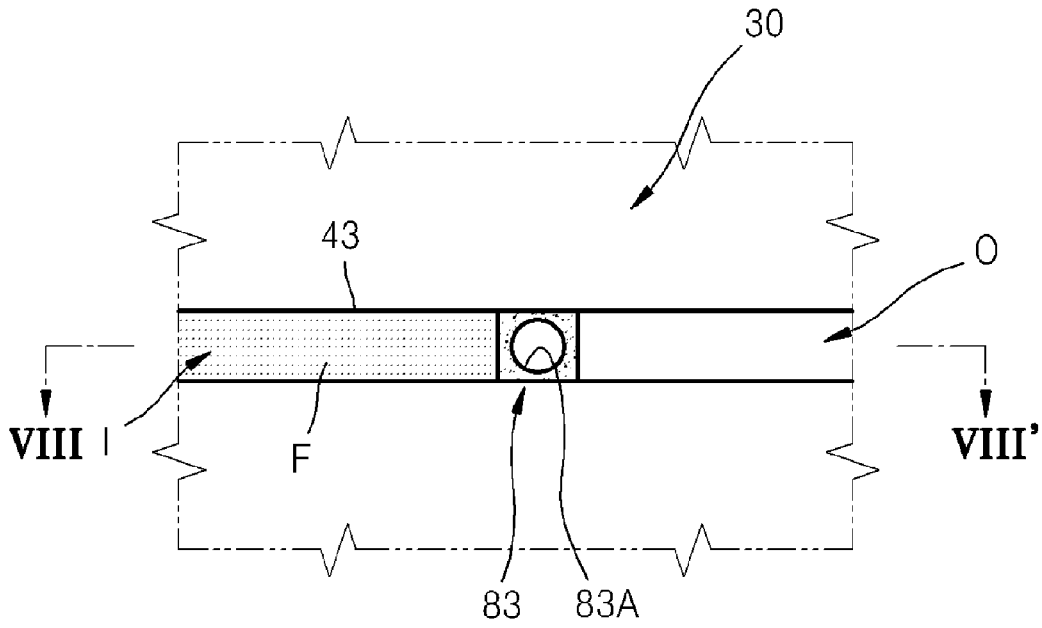
FIG. 7 is a plan view of an opening valve used in the microfluidic devices of FIGS. 1 through 3, according to an exemplary embodiment of the present invention.
Figure 8:
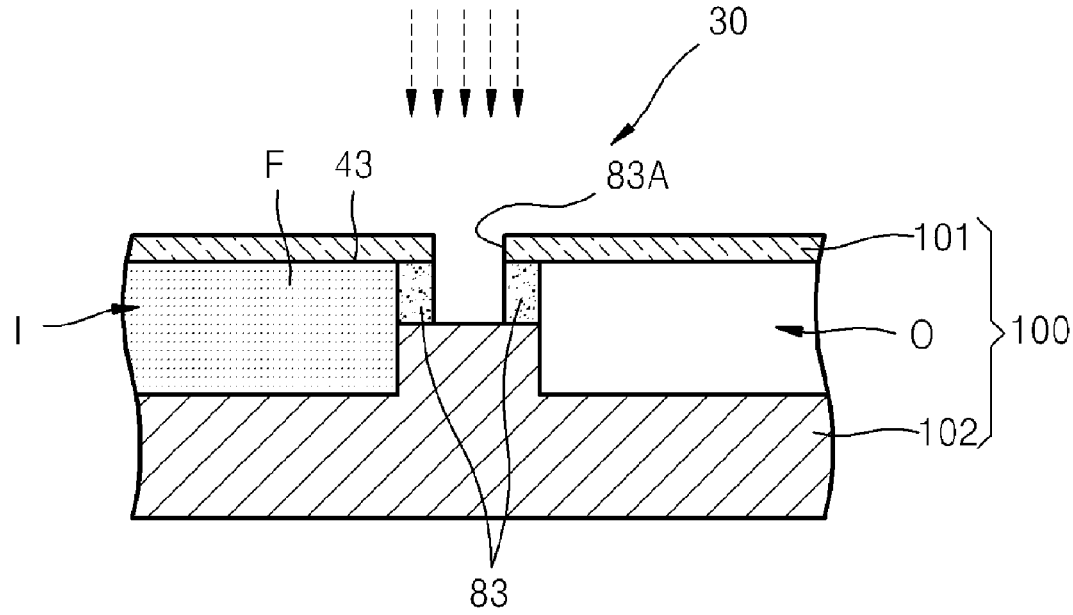
FIG. 8 is a sectional view of the opening valve taken along line VIII-VIII' of FIG. 7, according to an exemplary embodiment of the present invention.

FIG. 7 is a plan view of an opening valve 30 used as at least one of the opening valves included in the microfluidic devices of FIGS. 1 through 3. FIG. 8 is a sectional view of the opening valve 30 taken along the line VIII-VIII' of FIG. 7. Referring to FIGS. 7 and 8, the opening valve 30 may include a valve material that exists in a solid phase at room temperature. The valve material can be a dispersion medium composed of a phase transition material that exists in a solid phase at room temperature in which heat dissipating materials are dispersed.

The valve plug 83 completely plugs an opening 83A of a channel 43 at room temperature to block a fluid F flowing from an inlet I to an outlet O. The valve plug 83 is melted at high temperature and moves to the channel 43, and then returns to a solid phase and the channel 43 for the fluid F is opened. The opening 83A may act as a valve material inlet through which the valve material melted is loaded to form a valve plug in a process of fabricating a microfluidic device.

The valve plug 83 may be heated by an external energy source 300 (see FIGS. 14A through 14F) outside the disk-type platform 100. For example, the external energy source 300 may irradiate an electromagnetic wave to the valve plug 83 formed in an initial location, that is, to the opening 83A and an adjacent area to the opening 83A. Furthermore, the external energy source 300 can be, for example, a laser light source irradiating a laser beam. When the external energy source 300 is a laser light source irradiating a laser beam, the laser light source irradiating a laser beam may include at least one laser diode. When the laser light source irradiates laser pulses, each laser pulse may have the energy of 1 mJ/pulse or more. On the other hand, when the laser light source irradiates a continuous wave laser, the pulse laser may have the output energy of 10 mW or more.

An experiment to be described with reference to FIGS. 11 through 14 uses a laser light source irradiating a wavelength of 808 nm. However, the laser light source is not limited thereto. That is, the external energy source 300 can be any laser light source irradiating a wavelength from 400 to 1300 nm.

The channel 43 can be provided using a relief pattern formed in an inner surface of the top plate 101 or bottom plate 102 of the disk-type platform 100. The top plate 101 may be formed of an optically transparent material so that an electromagnetic wave irradiated from the external energy source 300 can be incident on the valve plug 83, and the flow of the fluid F can be observed outside. For example, a suitable material for the top plate 101 can be glass or a transparent plastic substance in terms of optical transparency and manufacturing costs.

The heat generating particles dispersed in the valve plug 83 may have a width of a few thousands of micrometers (μm) and a diameter from 1 nm to 100 μm so that the heat generating particles can flow easily in the channel 43. When a laser is irradiated to heat generating particles, temperature is quickly increased due to the irradiation energy, and thus heat generating particles dissipate heat. In addition, the heat generating particles may be uniformly dispersed in wax. To obtain these characteristics described above, the heat generating particles may be structured such that each dissipating particle includes a core including a metal and a shell having a hydrophobic property. For example, each dissipating particle may include a core formed of Fe that is a ferromagnetic material and a shell formed of surfactants binding and surrounding the Fe. In a related art, heat generating particles are stored being dispersed in a carrier oil. Heat generating particles dispersed in a carrier oil is called a ferrofluid. The carrier oil may have a hydrophobic property to uniformly disperse heat generating particles having a hydrophobic surface. The heat generating particles dispersed in a carrier oil is mixed with wax to prepare a material to be used to form the valve plug 83. Heat generating particles are not limited thereto. For example, heat generating particles can be polymerization beads, quantum dots, gold nanoparticles, silver nanoparticles, beads with metal composition, carbon particles, or magnetic beads. The carbon particles can be graphite particles.

The phase transition material forming the valve plug 83 can be wax. When heat generating particles absorb energy of an electromagnetic wave and the energy is transferred to the surroundings in a form of a thermal energy, the wax melts to have fluidity. Therefore, the valve plug 83 collapses and the channel 43 of the fluid F is opened. The wax forming the valve plug 83 may have an appropriate melting point. When the melting point of the wax is too high, the response time from when a laser is irradiated to when the wax melts is too long so that the timing for opening cannot be precisely controlled. On the other hand, when the melting point of the wax is too low, the wax may be partly melted even before the laser irradiation so that the fluid F may leak. The wax can be a paraffin wax, a microcrystalline wax, a synthetic wax, or a natural wax.

The phase transition material can be gel or a thermoplastic resin. The gel can be polyacrylamide, polyacrylates, polymethacrylates, polyvinylamides, or the like. The thermoplastic resin can be copolymer (COC), polymethylmethacrylate (PMMA), polycarbonate (PC), polystyrene (PS), polyoxymethylene (POM), perfluoralkoxy (PFA), polyvinylchloride (PVC), polypropylene (PP), polyethylene terephthalate (PET), polyetheretherketone (PEEK), polyamide (PA), polysulfone (PSU), or polyvinylidene fluoride (PVDF).

Figure 9:
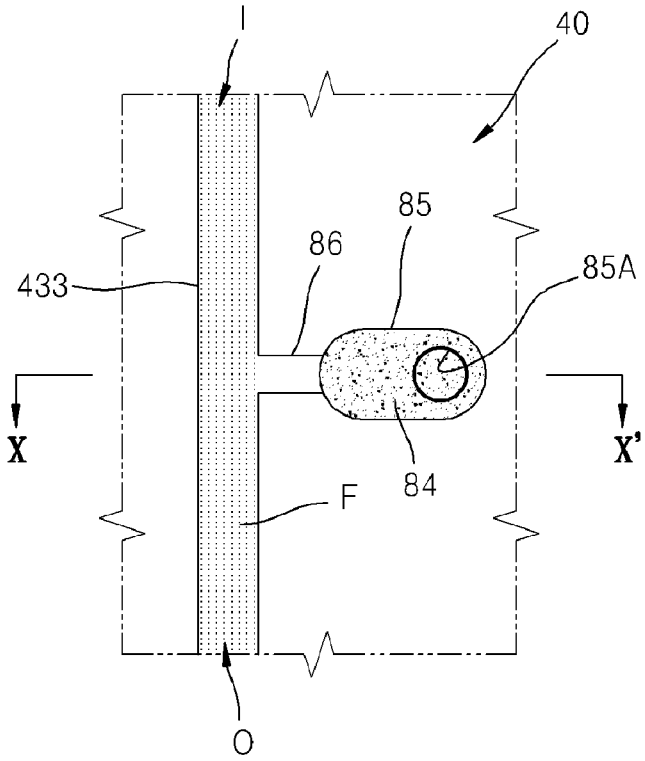
FIG. 9 is a plan view of a closing valve of the microfluidic device of FIG. 2, according to an exemplary embodiment of the present invention.
Figure 10:
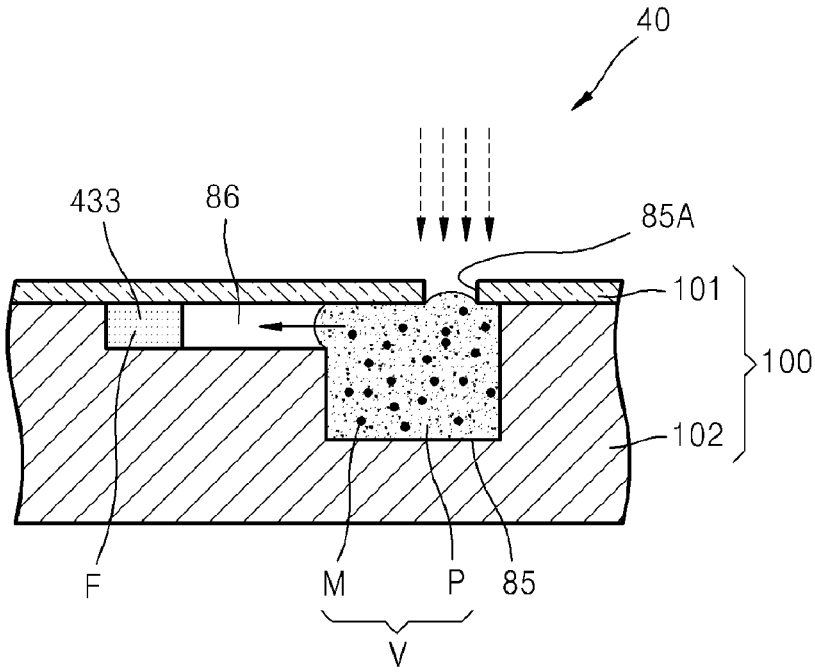
FIG. 10 is a sectional view of the closing valve taken a long line X-X' of FIG. 9, according to an exemplary embodiment of the present invention.

FIG. 9 is a plan view of a closing valve 40 used as at least one of the opening valves included in the microfluidic device of FIG. 2. FIG. 10 is a sectional view of the closing valve 40 taken a long line X-X' of FIG. 9. The closing valves 40 include a channel 433 having an inlet I and an outlet O, a valve material container 85 connected to a central portion of the channel 433 through a valve connecting channel, and a valve material V. The valve material V initially exists in a solid phase at room temperature filling the valve material container 85. However, when heated, the valve material V melts, expands and flows to the channel 433 through the valve connecting channel 86. Then, the valve material V in a liquid phase returned to the solid phase blocking the channel 433.

Like the opening valve 30, the closing valve 40 can be formed using a steric pattern formed in an inner surface of a top plate 101 or bottom plate 102 of a disk-type platform 100 of a microfluidic device. The top plate 101 may be formed of an optically transparent material so that an electromagnetic wave irradiated from an external energy source can be penetrate therethrough, and a fluid F can be externally observed. The top plate 101 may include an opening 85A corresponding to the valve material container 85 so that an electromagnetic wave, such as a laser beam, can easily contact the valve material V. The opening 85A may act as a valve material inlet through which the valve material V melted is loaded in a process of fabricating a microfluidic device.

The descriptions of a phase transition material P and heat generating particles M forming the valve material V are the same as the description described with reference to the opening valve 30. In addition, the description of the external energy source providing an electromagnetic wave to the valve material V is the same as described above.

When a laser beam is irradiated to the valve material V existing in a solid phase in the valve material container 85, heat generating particles M absorb energy and heat a phase transition material P. As a result, the valve material V melts, expands, and then flows to the channel 433 through the valve connecting channel 86. When the valve material V contacts the fluid F in the channel 433, the valve material V is converted into a solid phase. The valve material V in a solid phase blocks the fluid L flowing through the channel 433.

Response times of the open and closing valves described above were measured under the following conditions. For a test chip, the pressure of an operating fluid was maintained to 46 kPa using a syringe pump (Havard PHD2000, USA) and a press sensor (MPX 5500DP, Freescale semiconductor Inc., AZ, USA). A laser light source having an emission wavelength of 808 nm and an output of 1.5 W was used as an external energy source irradiating an electromagnetic wave to the open and closing valves. Response times of the open and closing valves were measured using experimental results obtained using a high-speed photographing device (Fastcam-1024, Photron, CA, USA). A magnetic wax in which a ferrofluid and a paraffin wax are mixed in a ratio of 1:1, that is, the volume of the ferrofluid used in the valve plug is 50%. The ferrofluid includes magnetic beads acting as heat generating particles dispersed in a carrier oil According to high-speed photos showing operation of the opening valve of FIG. 7, the response time from when a laser beam is irradiated to a valve plug of the opening valve to when the valve plug is melted and a channel is opened is 0.012 seconds.

Figure 11:
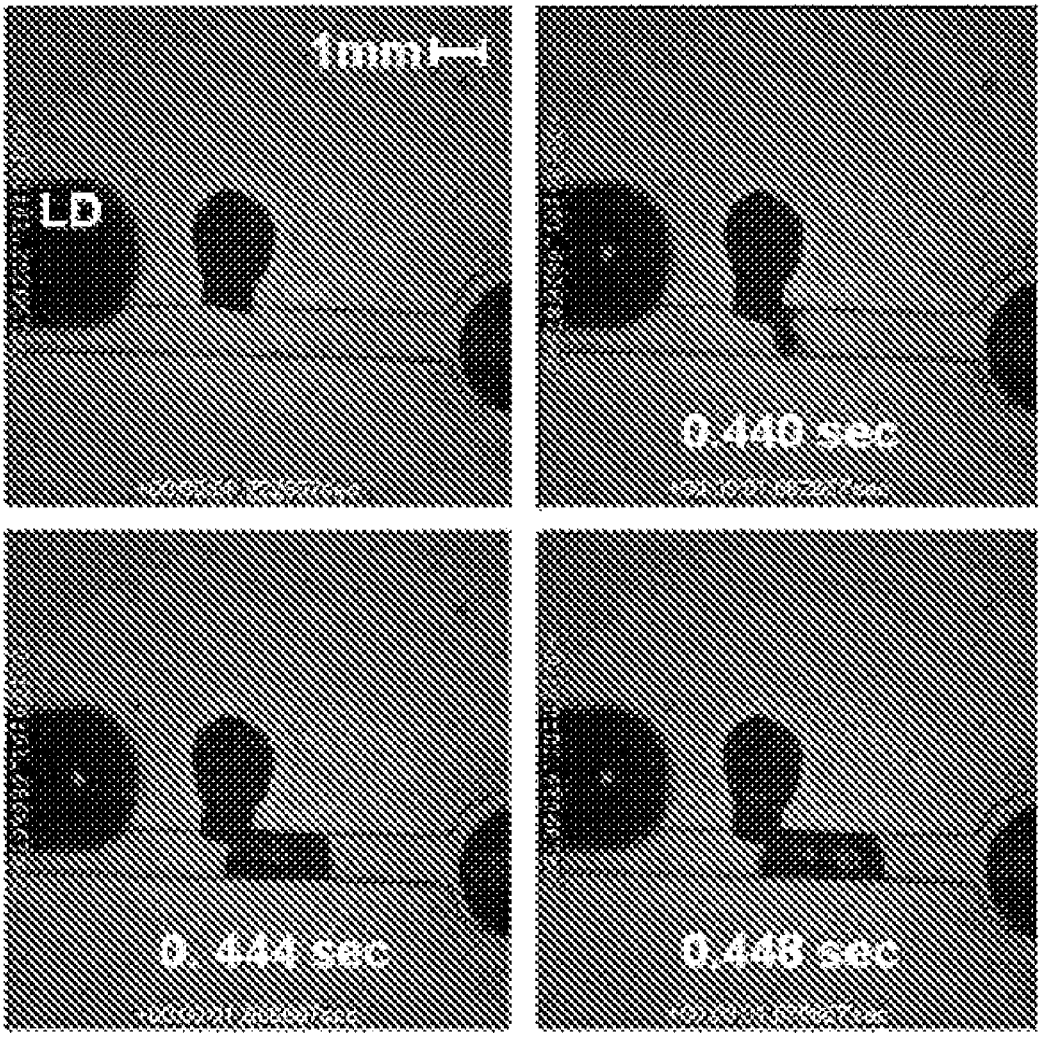
FIG. 11 illustrates high-speed photos showing operation of the closing valve of FIG. 9, according to an exemplary embodiment of the present invention.

FIG. 11 illustrates high-speed photos showing operation of the closing valve of FIG. 9. The response time from when a laser beam is irradiated to a valve material container of a closing valve to when the valve material is melted and expands, and a channel is closed is 0.444 seconds. Such a response time is much shorter than a response time of a related art wax valve from around 2 to 10 seconds.

Figure 12:
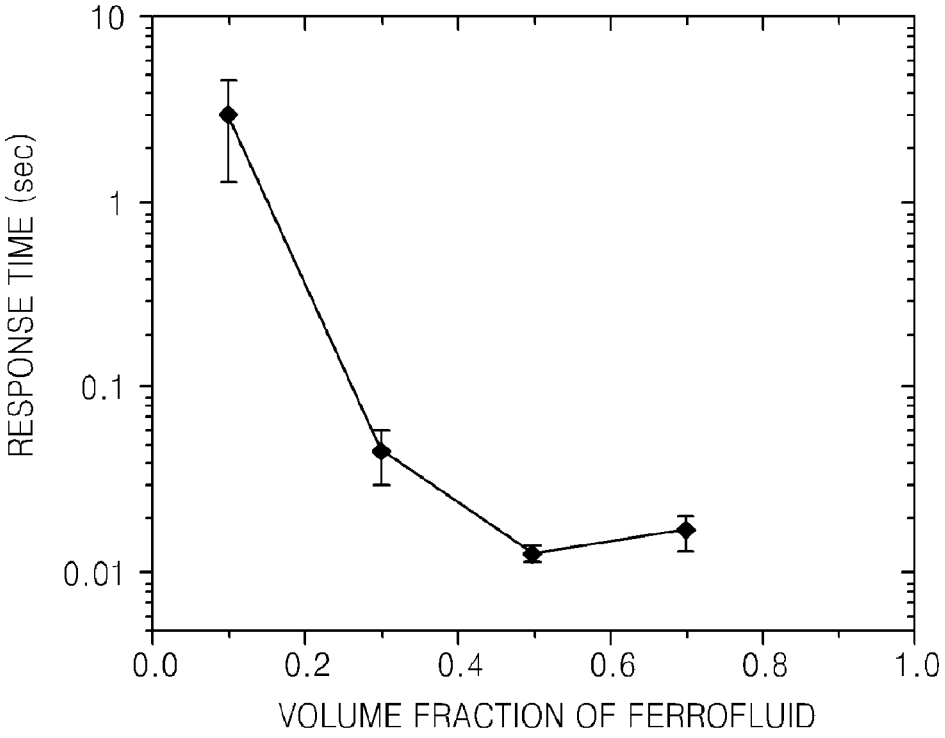
FIG. 12 is a graph of volume fraction of a ferrofluid contained in a valve plug in the opening valve of FIG. 7 with respect to a valve response time, according to an exemplary embodiment of the present invention.

FIG. 12 is a graph of volume fraction of a ferrofluid contained in a valve plug in the opening valve of FIG. 7 with respect to a valve response time. Generally, as the volume fraction of the ferrofluid increases, the response time decreases. However, when the volume fraction of the ferrofluid is 70% or more, the maximum hold-up pressure of the valve plug is decreased. Accordingly, the volume fraction of the ferrofluid to be included in a valve plug of a valve unit may be determined in consideration of a desired response time and a maximum hold-up pressure.

Figure 13:
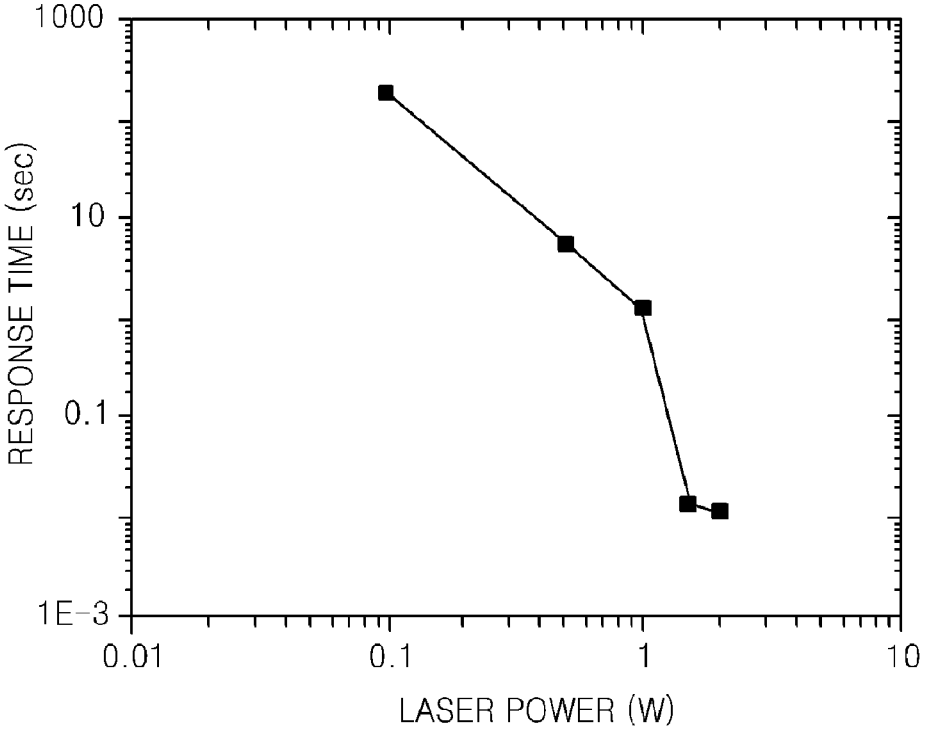
FIG. 13 is a graph of power of a laser light source that is an external energy source to operate the opening valve of FIG. 7 with respect to a valve response time, according to an exemplary embodiment of the present invention.

FIG. 13 is a graph of power of a laser light source that is an external energy source to operate the opening valve of FIG. 7 with respect to a valve response time. Referring to FIG. 13, as power of a laser light source increases, the response time is reduced. When the power of the laser light source is closer to 1.5 W, a change of the response time is reduced. On the other hand, when the power of the laser light source is 1.5 W or more, the response time approaches the minimum response time since there is a limit on thermal conductivity of a paraffin wax, which is not shown in FIG. 13. Therefore, in the current experiment, the energy of the laser light source used is 1.5 W. However, the external energy source used according to the exemplary embodiment of the present invention is not limited thereto.

FIG. 14A through FIG. 14F are perspective views sequentially illustrating an operation process of an open and close type valve 50 of the microfluidic device of FIG. 3. The open and close type valve 50 of the microfluidic device illustrated in FIG. 3 is a phase transition valve that independently operates by an external energy source. The open and close type valve 50 includes a valve material container 95, a valve material V loaded to the valve material container 95, a channel 46 through which a fluid F flows, a valve connecting channel 96 connecting the valve material container 95 to the channel 46, a pair of drain chambers 92 disposed in the channel 46 such that the valve connecting channel 96 is connected to a portion of the channel 46 between the pair of drain chambers. An external energy source 300 supplying energy to the valve material V can be a laser light source. The laser light source irradiates a laser L that is an electromagnetic wave. However, the external energy source 300 used according to an exemplary embodiment of the present invention is not limited to the laser light source. For example, an infra-red (IR) ray or a microwave that is an electromagnetic wave can be locally irradiated to provide energy to the valve material V.

The valve material container 95, the channel 46, the valve connecting channel 96, and the pair of drain chambers 92 may be formed in a disk-type platform 100 including a top plate 101 and a bottom plate 102 bound to the top plate 101. The top plate 101 and the bottom plate 102 can be bound to each other using an adhesive or a double-sided adhesive tape or using an ultrasonic fusing method. Specifically, the valve material container 95, the channel 46, the valve connecting channel 96, and the pair of drain chambers 92 are formed in concave patterns in the bottom plate 102. The top plate 101 may include an opening 95A to load the valve material V to the valve material container 95. Each of the channel 46 and the valve connecting channel 96 may have a width of about 1 mm and a depth of about 0.1 mm. The drain chamber 92 may have a depth of about 3 mm. The depth of the valve material container 95 may be smaller than the depth of the pair of drain chambers 92. For example, the depth of the valve material container 95 can be 1 mm.

Figure 14A:
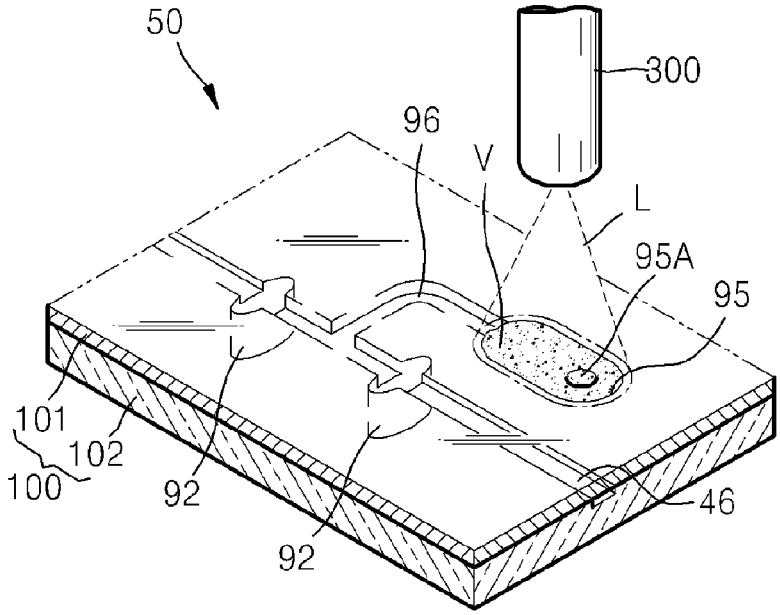
FIG. 14A through FIG. 14*f* are perspective views sequentially illustrating an operation process of an open and close type valve of the microfluidic device of FIG. 3, according to an exemplary embodiment of the present invention.
Figure 14B:
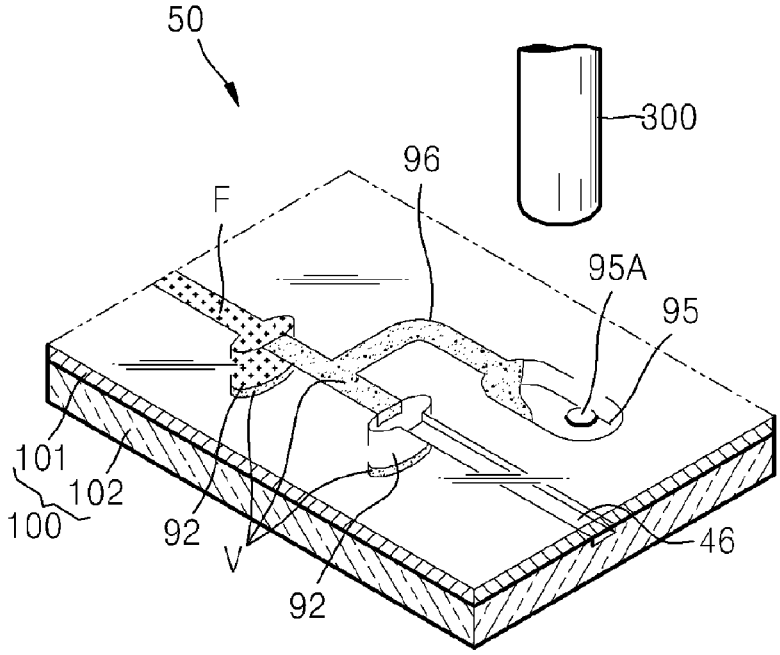

Referring to FIG. 14A, when the external energy source 300 irradiates a laser beam L to the valve material V which exists in a solid state in the valve material container 95 for a brief period of time, the valve material V is melted and significantly expands so that the valve material V flows to the channel 46 through the valve connecting channel 96. Referring to FIG. 14B, some of the valve material V that flows to the channel 46 is contained in the pair of drain chambers 92 according to a capillary phenomenon, and the rest of the valve material V that has flowed to the channel 46 and that remains in a portion of the channel 46 between the pair of drain chambers 92 is hardened to form a valve plug plugging the channel 46. Accordingly, a fluid F cannot flow through the channel 46.

Figure 14C:
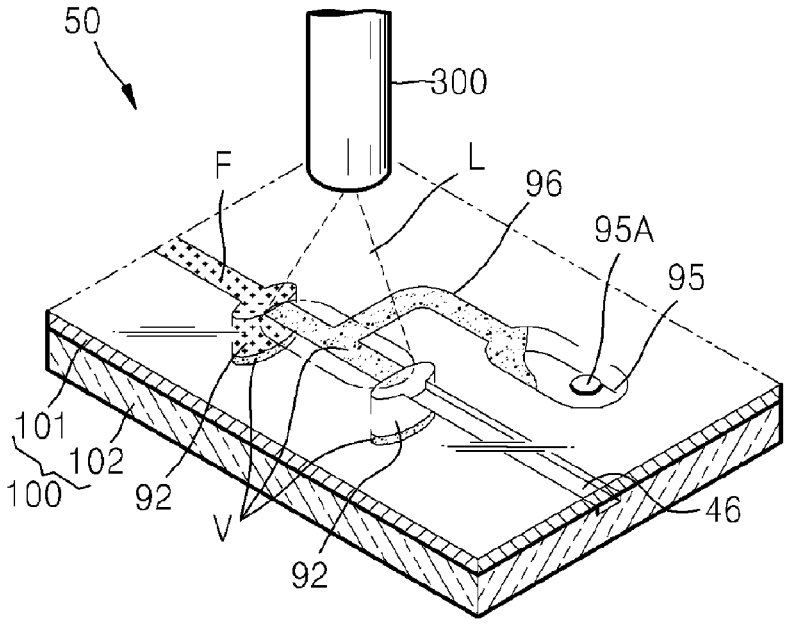
Figure 14D:
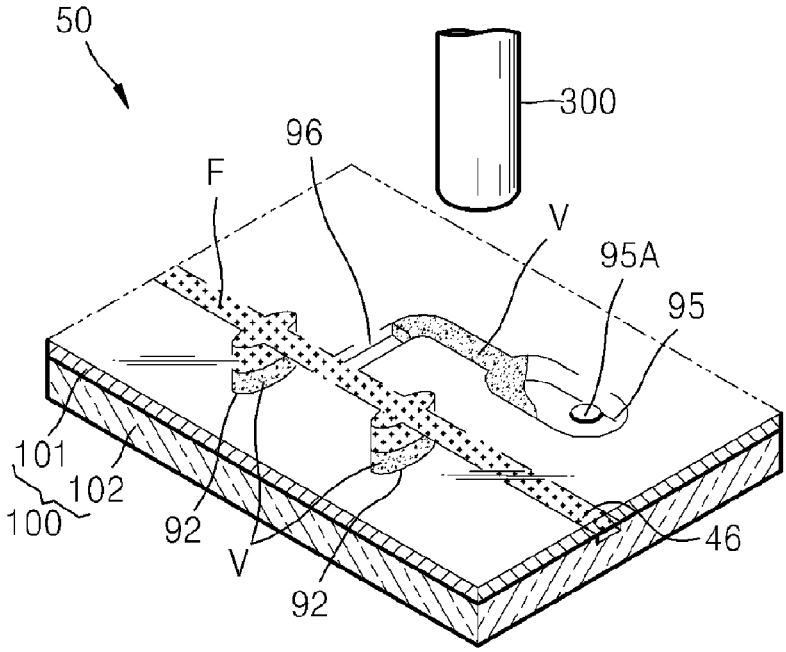

Referring to FIG. 14C, when the external energy source 300 irradiates a laser beam L to the valve material V existing in a solid phase between the pair of drain chambers 92 for a few moments, the valve material V in a solid phase is melted and significantly expands to flow into the pair of drain chambers 92. Therefore, as illustrated in FIG. 14D, the channel 46 is opened and thus the fluid F can flow through the channel 46.

Figure 14E:
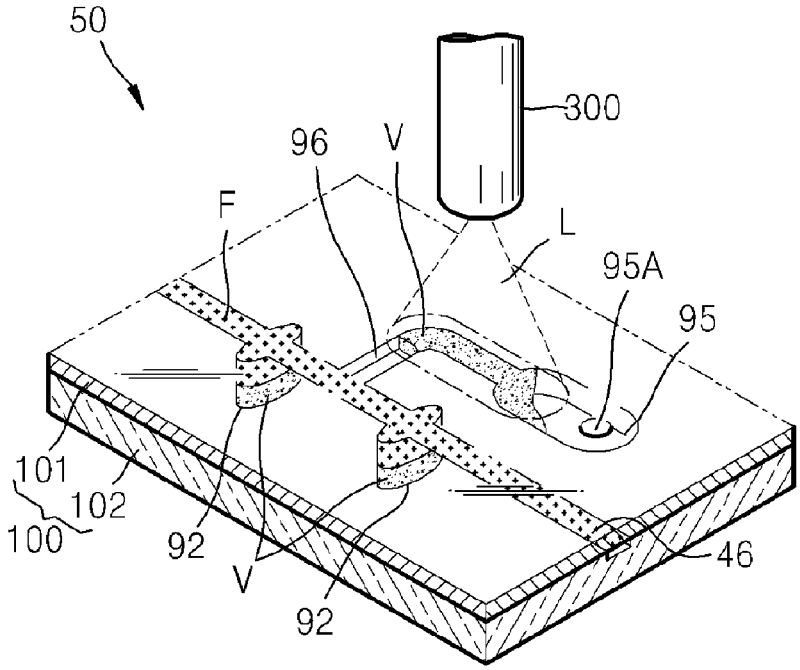
Figure 14F:
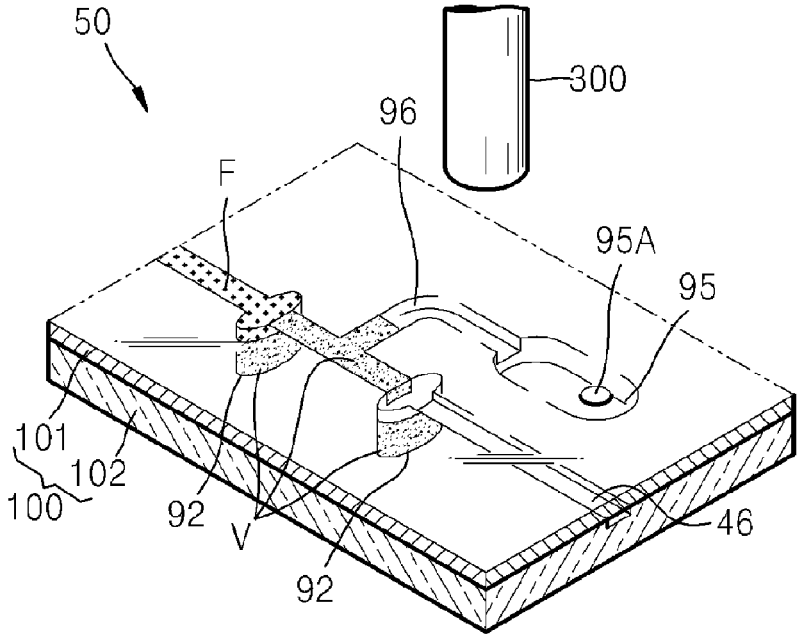

Referring to FIG. 14E, when the external energy source 300 irradiates a laser beam L to the valve material V which remains in the valve material container 95 and the valve connecting channel 96 for a brief period of time, the valve material V existing in a solid phase is melted and significantly expands to flow into the channel 46. As illustrated in FIG. 14F, the valve material V that does not flow into the pair of drain chambers 92 and remains in the channel 46 returns to a solid phase and blocks the channel 46. As such, the channel 46 can be repeatedly opened and closed until almost all of the valve material V flows into the drain chambers 92 by repeatedly irradiating a laser beam L.

A disk-type microfluidic device using a microfluidic chip according to the exemplary embodiments of the present invention is suitable for automatically performing various processes using a microfluidic chip in a disk-type platform microfluidic chip.

A disk-type microfluidic device using a biomolecule microarray chip according to the exemplary embodiments of the present invention uses various kinds of biomolecule microarray chips and requires few manual processes to be performed for experiments and diagnosis using a microarray chip.

Furthermore, an immune serum examination device using a protein microarray chip according to the exemplary embodiments of the present invention can use various protein microarray chips, and automatically performs the entire immune serum examination from a blood separating process to a chip washing process.

While the present invention has been particularly shown and described with reference to the exemplary embodiments thereof, it will be understood by those of ordinary skill in the art that various changes in form and details may be made therein without departing from the spirit and scope of the present invention as defined by the following claims.

What is claimed is:

1. A microfluidic device using a biomolecule microarray chip, the microfluidic device comprising:

a platform which is rotatable;

a microfluidic structure disposed in the platform, the microfluidic structure comprising:

a plurality of chambers;

a plurality of channels that connects the chambers to each other; and a plurality of valves that controls flow of fluids through the channels, wherein the microfluidic structure controls flow of a fluid sample using rotation of the platform and the valves; and a biomolecule microarray chip comprising biomolecule capture probes, forming an inner wall of one of the chambers and radially spaced from a rotation axis of the platform the biomolecule microarray chip being mounted in the platform such that the biomolecule capture probes contact the fluid sample in the microfluidic structure.

2. The microfluidic device of claim 1, wherein the plurality of chambers comprises a reagent chamber that stores a reagent which selectively binds a target biomolecule in the fluid sample and emits an optical indication, and a blend of the reagent and the fluid sample contacts the biomolecule microarray chip.

3. The microfluidic device of claim 1, wherein the plurality of chambers comprises a buffer solution chamber that stores a buffer solution, and the microarray chip is washed using different parts of the buffer solution in a plurality of washing processes.

4. The microfluidic device of claim 1, wherein the microfluidic structure further comprises a centrifugation unit that separates the fluid sample having particles into a fluid and the particles using a centrifugal force generated due to rotation of the platform, and wherein the fluid separated contacts the biomolecule microarray chip.

5. The microfluidic device of claim 1, wherein the plurality of chambers comprises a reaction chamber, and wherein the biomolecule microarray chip forms one of inner walls of the reaction chamber.

6. The microfluidic device of claim 5, wherein the microfluidic structure comprises:

a reagent chamber that stores a reagent which selectively binds a target biomolecule in the fluid sample and emits an optical indication;

a buffer solution chamber that stores a buffer solution; and a centrifugation unit that separates the fluid sample having particles into a fluid and the particles using a centrifugal force generated due to rotation of the platform, wherein the centrifugation unit, the reagent chamber, and the buffer solution chamber are connected to the reaction chamber.

7. The microfluidic device of claim 5, wherein the platform comprises a top plate and a bottom plate, and wherein the microfluidic structure is formed in facing surfaces of the top plate and bottom plate, an opening corresponding to the reaction chamber is formed in the bottom plate, and the opening is covered by the biomolecule microarray chip so that the reaction chamber is formed between a front surface of the biomolecule microarray chip and the top plate.

8. The microfluidic device of claim 5, wherein the platform comprises a top plate and a bottom plate, and wherein the microfluidic structure is formed in facing surfaces of the top plate and bottom plate, an opening corresponding to the reaction chamber is formed in the top plate, the biomolecule microarray chip is attached to the bottom plate exposed by the opening, and the opening is covered by a cover so that the reaction chamber is formed between a front surface of the biomolecule microarray chip and the cover.

9. The microfluidic device of claim 5, wherein the platform comprises a top plate and a bottom plate, and wherein the microfluidic structure is formed in facing surfaces of the top plate and bottom plate, the biomolecule microarray chip is attached to an inner surface of the top plate or the bottom plate, and the reaction chamber is formed between the biomolecule microarray chip and the top plate or the bottom plate to which the microarray chip is not attached.

10. The microfluidic device of claim 1, wherein each of the biomolecule capture probes is selected from a nucleic acid, a protein, a cell, or a biochemical material, each of which is specifically bound to a target material in the fluid sample.

11. The microfluidic device of claim 1, wherein the microfluidic device is used for immune serum examination, and wherein the biomolecule capture probes are protein capture probes, and the fluid sample comprises serum.

12. A microfluidic device using a biomolecule microarray chip, the microfluidic device comprising:

a platform which is rotatable;

a microfluidic structure disposed in the platform, the microfluidic structure comprising:

a plurality of chambers;

a plurality of channels that connects the chambers to each other; and a plurality of valves that controls flow of fluids through the channels, wherein the microfluidic structure controls flow of a fluid sample using rotation of the platform and the valves; and a biomolecule microarray chip mounted in the platform such that biomolecule capture probes bound to the biomolecule microarray chip contact the fluid sample in the microfluidic structure, wherein the microfluidic structure further comprises:

a centrifugation unit that separates the fluid sample having particles into a fluid and the particles using a centrifugal force generated due to rotation of the platform;

a reagent chamber that stores a reagent which selectively binds a target biomolecule in the fluid sample and expresses an optical indication;

a buffer solution chamber that storing a buffer solution;

a reaction chamber which is connected to outlets of the centrifugation unit, reagent chamber, and the buffer solution chamber, and is disposed further from a rotation axis of the platform than the outlets, wherein one of inner walls of the reaction chamber comprises the biomolecule microarray chip; and a waste chamber that receives the fluid sample from an outlet of the reaction chamber disposed further from the rotation axis of the platform than the reaction chamber.

13. The microfluidic device of claim 12, wherein the valves comprise a valve material having heat dissipating particles dispersed in a phase transition material dispersion medium, and wherein the valves comprise a phase transition valve in which the valve material is melted by heat generated due to an electromagnetic wave irradiated from an external energy source so that the phase transition valve opens or closes the channels.

14. The microfluidic device of claim 13, wherein at least one of the heat dissipating particles comprises:

a core that absorbs the electromagnetic wave to be converted into a thermal energy; and a shell surrounding the core.

15. The microfluidic device of claim 12, wherein each of the biomolecule capture probes is selected from a group comprising a nucleic acid, a protein, a cell, and a biochemical material, each of which is specifically bound to the target biomolecule in the fluid sample.

16. The microfluidic device of claim 12, wherein the platform comprises a top plate and a bottom plate, and wherein the microfluidic structure is formed in facing surfaces of the top plate and bottom plate, an opening corresponding to the reaction chamber is formed in the bottom plate, and the opening is covered by the biomolecule microarray chip so that the reaction chamber is formed between a front surface of the biomolecule microarray chip and the top plate.

17. The microfluidic device of claim 12, wherein the platform comprises a top plate and a bottom plate, and wherein the microfluidic structure is formed in facing surfaces of the top plate and bottom plate, an opening corresponding to the reaction chamber is formed in the top plate, the biomolecule microarray chip is attached to the bottom plate exposed by the opening, and the opening is covered by a cover so that the reaction chamber is formed between a front surface of the biomolecule microarray chip and the cover.

18. The microfluidic device of claim 12, wherein the platform comprises a top plate and a bottom plate, and wherein the microfluidic structure is formed in facing surfaces of the top plate and bottom plate, the biomolecule microarray chip is attached to an inner surface of the top plate or the bottom plate, and the reaction chamber is formed between the biomolecule microarray chip and the top plate or the bottom plate to which the microarray chip is not attached.

19. The microfluidic device of claim 12, wherein the biomolecule capture probes are protein capture probes, the fluid sample comprises serum, and the target biomolecule is protein.

20. A microfluidic device comprising:

a platform which is rotatable;

a microfluidic structure disposed in the platform, the microfluidic structure comprising:

a plurality of chambers;

a plurality of channels that connects the chambers each other; and a plurality of valves that controls flow of fluids through the channels, wherein the microfluidic structure controls flow of a fluid sample using rotation of the platform and the valves; and a microfluidic chip-receiving unit which is disposed in a portion of the microfluidic structure and comprises:

an inlet through which the fluid sample is supplied to a biomolecule microfluidic chip comprised in the microfluidic chip-receiving unit; and an outlet through which the fluid sample that has contacted the biomolecule microfluidic chip is discharged, and wherein the biomolecule microfluidic chip comprises biomolecule capture probes forming an inner wall of one of the chambers and radially spaced from a rotation axis of the platform to contact the fluid sample in the microfluidic structure.

21. The microfluidic device of claim 20, wherein the inlet of the microfluidic chip-receiving unit is disposed closer to the a rotation axis of the platform than the outlet.

22. The microfluidic device of claim 20, wherein the platform comprises a top plate and a bottom plate, and wherein the microfluidic structure is formed in facing surfaces of the top plate and bottom plate, an opening exposing the microfluidic chip-receiving unit is formed in the bottom plate, and the opening is covered by the microfluidic chip so as to form a chamber between a front surface of the biomolecule microfluidic chip and the top plate.

23. The microfluidic device of claim 20, wherein the platform comprises a top plate and a bottom plate, and wherein the microfluidic structure is formed in facing surfaces of the top plate and bottom plate, an opening exposing the microfluidic chip-receiving unit is formed in the top plate, the microfluidic chip is attached to the bottom plate exposed by the opening, and the opening is covered by a cover so as to form a chamber between a front surface of the biomolecule microfluidic chip and the cover.

24. The microfluidic device of claim 20, wherein the platform comprises a top plate and a bottom plate, and wherein the microfluidic structure is formed in facing surfaces of the top plate and bottom plate, the microfluidic chip-receiving unit is formed in a chamber-like form between the top plate and the bottom plate, the biomolecule microfluidic chip and the other inner walls of the chamber form a space.

25. The microfluidic device of claim 20, wherein the microfluidic chip can be selected from a group comprising a microarray chip, a polymerase chain reaction (PCR) chip, a hexane nucleic acid refinement chip, and a sample separation chip.

* * * * *